US007792475B2

(12) United States Patent
Seol

(10) Patent No.: US 7,792,475 B2
(45) Date of Patent: Sep. 7, 2010

(54) IMAGE FORMING APPARATUS AND HEATING UNIT THEREOF

(75) Inventor: Dong Jin Seol, Suwon-si (KR)

(73) Assignee: Samsung Electronics Co., Ltd, Suwnon-si, Gyeonggi-do ( * ) Notice: Subject to any disclaimer, the term of this patent is extended or adjusted under 35 U.S.C. 154(b) by 151 days.

(21) Appl. No.: 12/036,483

(22) Filed: Feb. 25, 2008

(65) Prior Publication Data

US 2008/0219727 A1 Sep. 11, 2008

(30) Foreign Application Priority Data

Mar. 6, 2007 (KR) ..... 10-2007-0021962

(51) Int. Cl.
*G03G 15/20* (2006.01)

(52) U.S. Cl. ..... 399/329; 219/216; 399/333; 430/124.3

(58) Field of Classification Search ..... 399/328, 399/329, 330, 333; 219/216, 255, 470; 347/156; 118/60; 430/124.3
See application file for complete search history.

(56) References Cited

U.S. PATENT DOCUMENTS 5,309,210 A * 5/1994 Yamamoto et al. ..... 399/329
5,974,294 A * 10/1999 Tange ..... 399/328
6,841,758 B2 * 1/2005 Eskey ..... 219/216
2003/0002895 A1 * 1/2003 Kato et al. ..... 399/333

FOREIGN PATENT DOCUMENTS

| | | |
|---|---|---|
| CN | 1154886 | 7/1997 |
| CN | 1504065 | 6/2004 |
| JP | 11-249467 | 9/1999 |
| JP | 11-352813 | 12/1999 |

OTHER PUBLICATIONS

Machine translation of JP 11-249467 A dated Feb. 4, 2010.*
Chinese Office Action issued Aug. 14, 2009 in CN Application No. 200810127782X.

* cited by examiner

*Primary Examiner*—Sophia S Chen
(74) *Attorney, Agent, or Firm*—Stanzione & Kim, LLP

(57) ABSTRACT

An image forming apparatus to shorten a warm-up time required to fuse a visible image to a printing medium is provided. The image forming apparatus includes an indirect heating member to indirectly transfer radiant heat to the visible image formed on the printing medium passing through the fusing nip, and a direct heating member to directly transfer resistance heat to the visible image formed on the printing medium passing through the fusing nip. Accordingly, since the radiant heat generated from the indirect heating member heats the direct heating member, a heating rate of the direct heating member increases, and the warm-up time required to reach a predetermined fusing temperature to fuse the visible image is shortened.

13 Claims, 5 Drawing Sheets

IMAGE FORMING APPARATUS AND HEATING UNIT THEREOF

CROSS-REFERENCE TO RELATED APPLICATIONS

This application claims priority under 35 U.S.C. §119(a) from Korean Patent Application No. 2007-0021962, filed on Mar. 6, 2007 in the Korean Intellectual Property Office, the disclosure of which is incorporated herein in its entirety by reference.

BACKGROUND OF THE INVENTION

1. Field of the Invention

The present general inventive concept relates to an image forming apparatus, and more particularly to an image forming apparatus to shorten a warm-up time so as to effectively fuse a visible image formed on a printing medium by a developing device.

2. Description of the Related Art

Generally, an image forming apparatus is an apparatus that prints an image on a printing medium, e.g., paper, according to an input image signal. As one example of the image forming apparatus, an electrophotographic image forming apparatus is configured such that a light beam is scanned to a photosensitive member charged with an electric potential to form an electrostatic latent image on an outer peripheral surface of the photosensitive member, the electrostatic latent image is developed into a visible image by supplying yellow, magenta, cyan and black developer to the electrostatic latent image, and the visible image is transferred and fused onto paper.

The electrophotographic image forming apparatus is provided with a fusing device for fusing the visible image formed on paper by a developing device containing developer of four colors by applying heat and pressure to the visible image. The fusing device includes a heating unit having a heat source therein and a pressing unit pressing the heating unit to form a fusing nip between the pressing unit and the heating unit.

The heat source provided in the heating unit is classified as an indirect heating type or a direct heating type. The image fusing method using the indirect heating type heat source is to fuse the visible image to the paper passing through the fusing nip by using radiant heat from a halogen lamp provided inside the heating unit. The image fusing method using the direct heating type heat source is to fuse the visible image to the paper passing through the fusing nip by using direct heat transfer from a resistance heating element provided inside the heating unit.

However, the conventional image forming apparatus structured to fuse the visible image to the paper, using the fusing device provided with the indirect heating type heat source, has the problem that heat loss is generated while the radiant heat from the halogen lamp is transferred to the paper and thus a warm-up time required to reach a predetermined fusing temperature for fusing the visible image increases. Also, a resistance in an early stage of heating is low, and it causes the halogen lamp to flicker.

Also, the conventional image forming apparatus structured to fuse the visible image to the paper using the fusing device provided with the direct heating type heat source has the problem that the fusing belt should be preheated. This is because only a portion of the fusing belt contacting the resistance heating element is heated and the heat is transferred to a non-heated portion of the fusing belt which is not in contact with the resistance heating element. Therefore, the warm-up time required to reach a predetermined fusing temperature for fusing the visible image increases.

SUMMARY OF THE INVENTION

The general inventive concept provides an image forming apparatus to shorten a warm-up time required to fuse a visible image to a printing medium.

Additional aspects and utilities of the present general inventive concept will be set forth in part in the description which follows and, in part, will be obvious from the description, or may be learned by practice of the general inventive concept.

The foregoing and/or other aspects and utilities of the general inventive concept may be achieved by providing an image forming apparatus including a heating unit and a pressing unit which forms a fusing nip between the heating unit and the pressing unit to fuse a visible image formed on a printing medium, the image forming apparatus including the heating unit including an indirect heating member to indirectly transfer heat to the visible image formed on the printing medium passing through the fusing nip, and a direct heating member to directly transfer heat to the visible image formed on the printing medium passing through the fusing nip.

The indirect heating member may be a heating member to generate radiant heat.

The direct heating member may include a resistance heating element to generate resistance heat when power is applied to the resistance heating element, and an insulation element disposed on the resistance heating element so that power is stably applied to the resistance heating element.

The resistance heating element may include a ceramic material selected from the group consisting of ZnO, ITO, and $SnO_2$, or a light transmitting material selected from the group consisting of CNT and polythiophene-based conductive polymer, so that the radiant heat generated from the indirect heating member can permeate the resistance heating element.

The insulation element may include a light transmitting glass material so that the radiant heat permeating the resistance heating element permeates the insulation element.

The heating unit may further include a support element to support the resistance heating element and the insulation element. The support element may include of a ceramic material selected from the group consisting of $SiO_2$ and $Al_2O_3$, or a light transmitting material of a high heat-resistant polymer material, wherein the high heat-resistant polymer material is PI.

The foregoing and/or other aspects and utilities of the general inventive concept may also be achieved by providing an image forming apparatus including a fusing device having a heating unit and a pressing unit which is mounted opposite to the heating unit to fuse a visible image formed on a printing medium, that the image forming apparatus including the heating unit including a fusing belt, an indirect heating member disposed inside the fusing belt to generate radiant heat, and a direct heating member which the radiant heat generated from the indirect heating member permeates and generates resistance heat.

The direct heating member may include a support element, a resistance heating element disposed on the support element to generate resistance heat when power is applied to the resistance heating element, and an insulation element disposed on the resistance heating element so that power is stably applied to the resistance heating element.

The resistance heating element may include a ceramic material selected from the group consisting of ZnO, ITO, and $SnO_2$, or a light transmitting material selected from the group consisting of CNT and polythiophene-based conductive polymer, so that the radiant heat generated from the indirect heating member can permeate the resistance heating element.

The insulation element may include a light transmitting glass material so that the radiant heat permeating the resistance heating element permeates the insulation element.

The support element may include a ceramic material selected from the group consisting of $SiO_2$ and $Al_2O_3$, or a light transmitting material of a high heat-resistant polymer material, wherein the high heat-resistant polymer material is PI.

The support element includes shafts to protrude outward from both sides of the support element, bushings to press the shafts and elastic members to elastically support the bushings disposed at the respective shafts to form a fusing nip between the fusing belt and the pressing unit.

The foregoing and/or other aspects and utilities of the general inventive concept may also be achieved by providing an image forming apparatus including a fusing device having a heating unit and a pressing unit which is mounted opposite to the heating unit to fuse a visible image formed on a printing medium, the image forming apparatus including the heating unit includes a heat roller to generate resistance heat and to form a fusing nip between the pressing unit and the heat roller, and an indirect heating member disposed inside the heat roller to generate radiant heat.

The heat roller includes a support pipe, a resistance heating element disposed on an outer surface of the support pipe, and an insulation element disposed on an outer surface of the resistance heating element.

The support pipe may include a ceramic material selected from the group consisting of $SiO_2$ and $Al_2O_3$, or a light transmitting material of a high heat-resistant polymer material, wherein the high heat-resistant polymer material is PI, so that the radiant heat generated from the indirect heating member can permeate the support pipe.

The resistance heating element may include a ceramic material selected from the group consisting of ZnO, ITO, and $SnO_2SnO_2$, or a light transmitting material selected from the group consisting of CNT and polythiophene-based conductive polymer, so that the radiant heat generated from the indirect heating member can permeate the resistance heating element.

The insulation element may include a light transmitting glass material so that the radiant heat permeating the resistance heating element permeates the insulation element.

The foregoing and/or other aspects and utilities of the general inventive concept may also be achieved by providing an image forming apparatus including a fusing device having a heating unit and a pressing unit which is mounted opposite to the heating unit to fuse a visible image formed on the printing medium, the image forming apparatus including the heating unit including a heat roller to generate resistance heat, an indirect heating member disposed inside the heat roller and generates radiant heat, and a fusing belt disposed around the heat roller and forms a fusing nip between the pressing unit and the fusing belt.

The heat roller may include a support pipe, a resistance heating element disposed on an outer surface of the support pipe, and an insulation element disposed on an outer surface of the resistance heating element.

The support pipe may include a ceramic material selected from the group consisting of $SiO_2$ and $Al_2O_3$, or a light transmitting material of a high heat-resistant polymer material, wherein the high heat-resistant polymer material is PI.

The resistance heating element may include a ceramic material selected from the group consisting of ZnO, ITO, and $SnO_2$, or a light transmitting material selected from the group consisting of CNT and polythiophene-based conductive polymer, so that the radiant heat generated from the indirect heating member can permeate the resistance heating element.

The insulation element may include a light transmitting glass material so that the radiant heat permeating the resistance heating element permeates the insulation element.

The foregoing and/or other aspects and utilities of the general inventive concept may also be achieved by providing a heating unit usable with an image forming apparatus, the heating unit including a direct heating member to generate radiant heat and an indirect heating member to generate resistance heat, wherein the indirect heating member and the direct heating member operate simultaneously to transfer heat to a visible image formed on a printing medium.

The foregoing and/or other aspects and utilities of the general inventive concept may also be achieved by providing an image forming apparatus including a pressing unit and a heating unit disposed proximate to the pressing unit to form a fusing nip therebetween to fuse a visible image formed on a printing medium, the heating unit includes a direct heating member to generate radiant heat and an indirect heating member to generate resistance heat, wherein the indirect heating member and the direct heating member operate simultaneously to transfer heat to a visible image formed on a printing medium passing through the fusing nip.

The foregoing and/or other aspects and utilities of the general inventive concept may also be achieved by providing a method to fuse a visible image on a printing medium, the method including passing the printing medium through a fusing nip, generating resistance heat to indirectly transfer to the printing medium passing through the fusing nip and generating radiant heat to directly transfer to the printing medium passing through the fusing nip.

The foregoing and/or other aspects and utilities of the general inventive concept may also be achieved by providing a method to fuse a visible image on a printing medium, the method including passing the printing medium through a fusing nip, generating resistance heat to indirectly transfer to the printing medium passing through the fusing nip and generating radiant heat to directly transfer to the printing medium passing through the fusing nip.

The foregoing and/or other aspects and utilities of the general inventive concept may also be achieved by providing a computer-readable recording medium having embodied thereon a computer program to execute a method, wherein the method includes passing a printing medium through a fusing nip, generating resistance heat to indirectly transfer to the printing medium passing through the fusing nip and generating radiant heat to directly transfer to the printing medium passing through the fusing nip.

BRIEF DESCRIPTION OF THE DRAWINGS

These and/or other aspects and utilities of the present general inventive concept will become apparent and more readily appreciated from the following description of the embodiments, taken in conjunction with the accompanying drawings, of which.

DETAILED DESCRIPTION OF THE PREFERRED EMBODIMENTS

Figure 1:
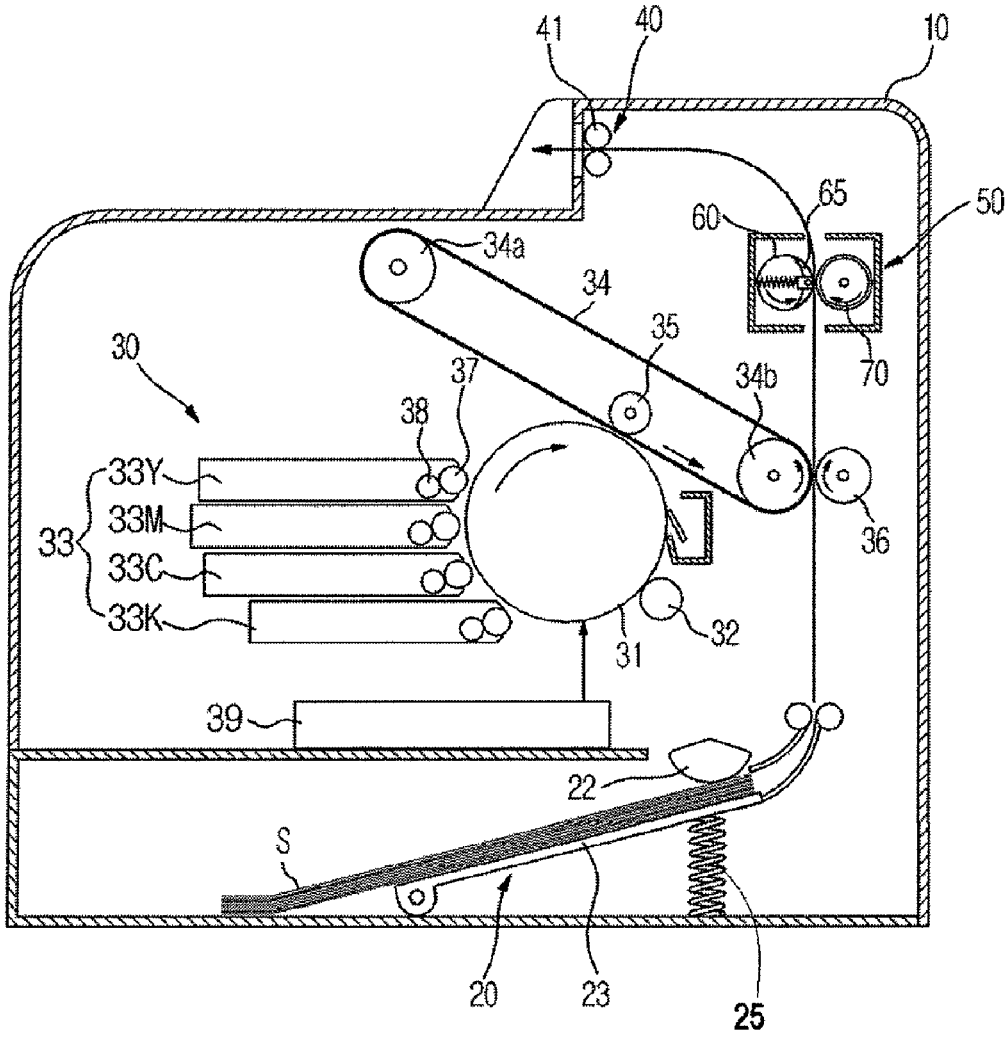
FIG. 1 is a sectional view illustrating an image forming apparatus in accordance with the present general inventive concept.

Reference will now be made in detail to embodiments of the present general inventive concept, examples of which are illustrated in the accompanying drawings, wherein like reference numerals refer to like elements throughout. The embodiments are described below in order to explain the present general inventive concept by referring to the figures.

FIG. 1 is a sectional view illustrating an image forming apparatus in accordance with the present general inventive concept.

As illustrated in FIG. 1, the image forming apparatus according to embodiments of the present general inventive concept includes a main body 10 to form an exterior appearance and supports components mounted therein, a printing medium supply device 20 to supply printing medium such as paper S to be printed, a developing device 30 to develop an image on the paper, a fusing device 50 to fuse the image to the paper by applying heat and pressure to the paper, and a printing medium discharge device 40 to discharge the printed paper to an exterior of the main body 10.

The printing medium supply device 20 includes a printing medium cassette which is detachably mounted to a lower portion of the main body 10, a printing medium tray 23 hingedly provided in the printing medium cassette, on which the paper S is loaded, an elastic member 25 which is provided below the printing medium tray 23 to elastically support the printing medium tray 23, and a pickup roller 22 which is provided near a front end of the paper loaded on the printing medium tray 23 to pick up the paper and feed the paper to the developing device 30.

The developing device 30 includes a photosensitive member 31 on which an electrostatic latent image is formed by an exposure member 39, a charge roller 32 to charge the photosensitive member 31, four development cartridges 33 which develop the electrostatic latent image formed on the photosensitive member 31 into a visible image using yellow (Y), magenta (M), cyan (C) and black (K) developer, an intermediate transfer belt 34, a first transfer roller 35, and a second transfer roller 36. Hereinafter, when it is needed to classify the components by colors, "Y", "M", "C" and "K" will be added after the reference numerals denoting the respective components.

Each of the development cartridges 33 includes a development roller 37 to develop the electrostatic latent image formed on the photosensitive member 31 into the visible image, and a supply roller 38 which rotates while contacting the development roller 37 and supplies the developer to the development roller 37.

The intermediate transfer belt 34 is supported by supporting rollers 34*a* and 34*b*, and runs at a same velocity as a linear velocity of the rotating photosensitive member 31. The first transfer roller 35 opposes the photosensitive member 31, and transfers the visible image developed on the photosensitive member 31 onto the intermediate transfer belt 34. The second transfer roller 36 is disposed opposite to the intermediate transfer belt 34. While the visible image is transferred onto the intermediate transfer belt 34 from the photosensitive member 31, the second transfer roller 36 is spaced apart from the intermediate transfer belt 34. When the visible image is completely transferred onto the intermediate transfer belt 34, the second transfer roller 36 comes into contact with the intermediate transfer belt 34 with a predetermined pressure.

The fusing device 50 is to fuse the visible image to the printing medium by applying heat and pressure thereto. The detailed explanation of the fusing device 50 will be made later.

The printing medium discharge device 40 includes discharge rollers 41 which are sequentially mounted to discharge the paper S having passed through the fusing device 50 to an exterior of the main body 10.

Figure 2:
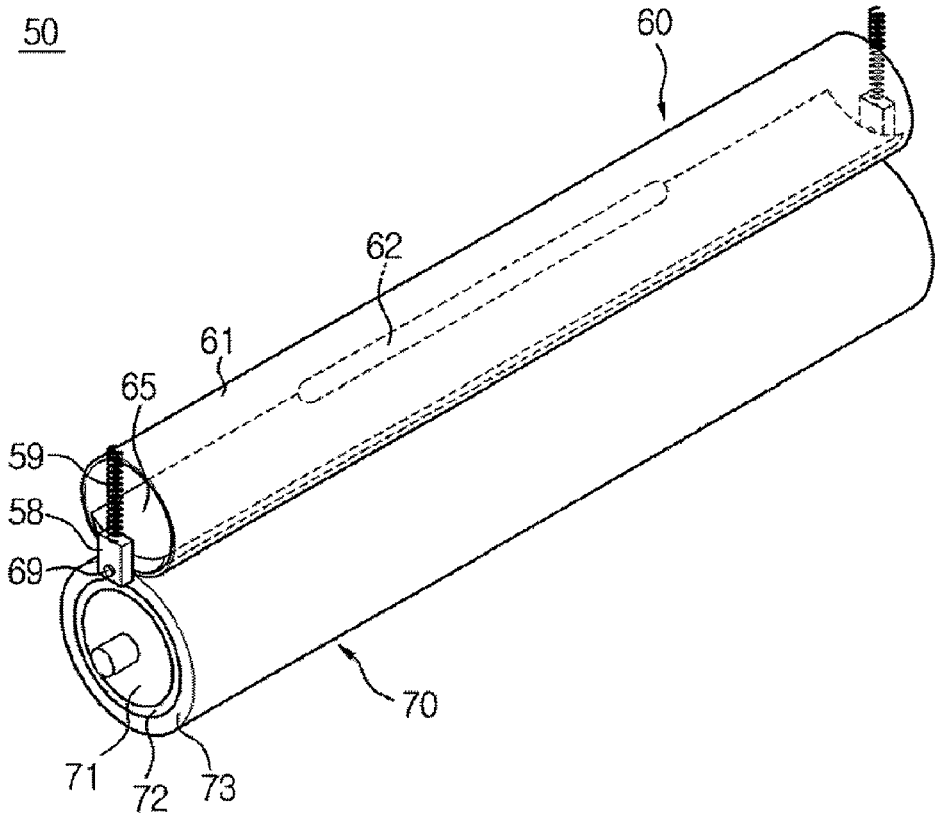
FIG. 2 is a perspective view illustrating a fusing device of the image forming apparatus in accordance with the present general inventive concept.

FIG. 2 illustrates the fusing device of the image forming apparatus according to embodiments of the present general inventive concept.

As illustrated in FIG. 2, the fusing device 50 includes a heating unit 60 and a pressing unit 70 which is mounted opposite to the heating unit 60.

The heating unit 60 includes a fusing belt 61, an indirect heating member 62 disposed inside the fusing belt 61, such as at the middle of the fusing belt 61, and a direct heating member 65 which is disposed in contact with an inner surface of the fusing belt 61.

If power is applied to the indirect heating member 62, the indirect heating member 62 generates radiant heat. The indirect heating member 62 may be configured as a halogen lamp. The radiant heat generated from the indirect heating member 62 is transferred to the visible image formed on the paper to fuse the visible image while the paper passes through a fusing nip formed between the pressing unit 70 and the heating unit 60.

Figure 3:
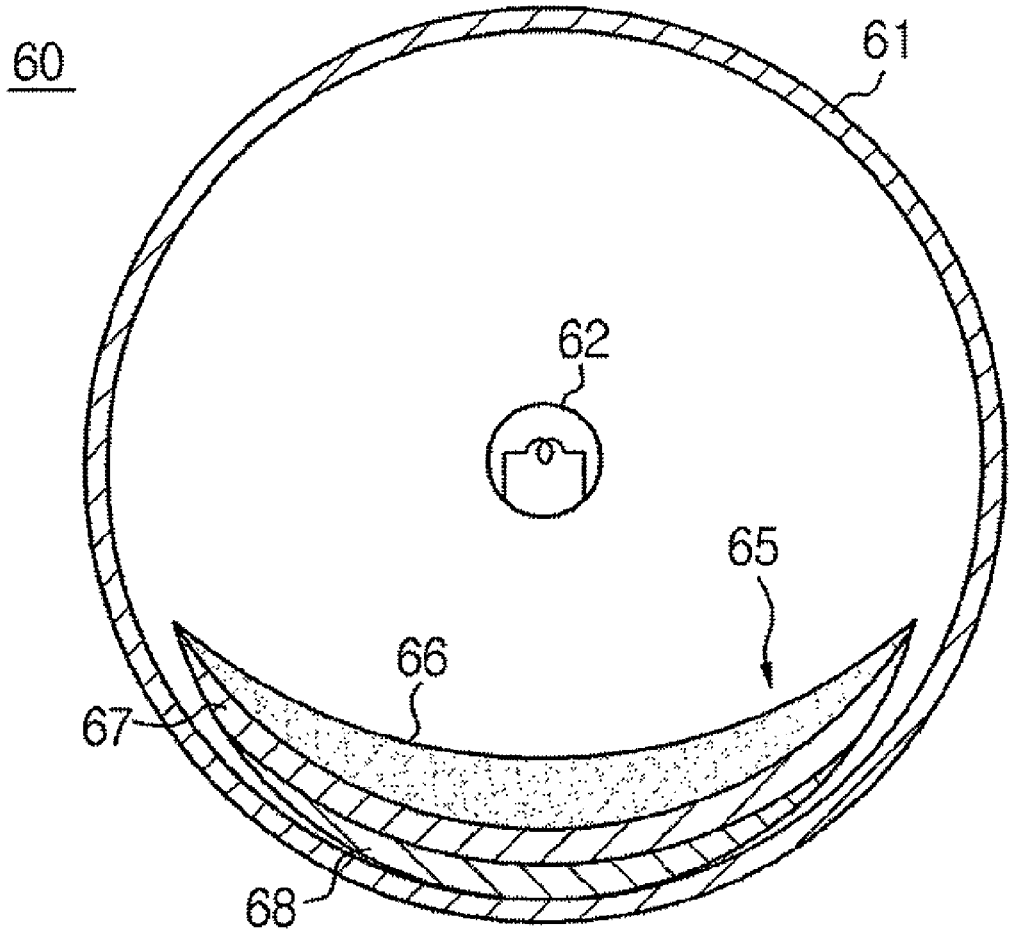
FIG. 3 is a sectional view illustrating a heating unit of the image forming apparatus in accordance with the present general inventive concept.

As illustrated in FIG. 3, the direct heating member 65 presses the fusing belt 61 to form the fusing nip between the fusing belt 61 and the pressing unit 70 (FIG. 2). The direct heating member 65 includes a support element 66, a resistance heating element 67 disposed on the support element 66, and an insulation element 68 disposed on the resistance heating element 67.

The support element 66 is made of a ceramic material such as silicon dioxide ($SiO_2$) or aluminum oxide ($Al_2O_3$), or a light transmitting material of a high heat-resistant polymer material such as polyimide (PI), so that the radiant heat from the indirect heating member 62, Le., the halogen lamp, can permeate the support element 66. The support element 66 is provided with shafts 69 which protrude outward from both sides of the support element 66 to press the fusing belt 61. Bushings 58 to press the shafts 69 and elastic members 59 elastically supporting the bushings 58 are provided around the respective shafts 69.

The resistance heating element 67 disposed on an outer surface of the support element 66 is coated with a resistance heating material so as to directly transfer heat to the fusing nip formed between the fusing belt 61 and the pressing unit 70. The resistance heating element 67 is made of a ceramic material such as zinc oxide (ZnO), indium tin oxide (ITO) or tin dioxide ($SnO_2$)or a light transmitting material such as carbon nanotube (CNT) or polythiophene-based conductive polymer, so that the radiant heat permeating the support element 66 can permeate the resistance heating element 67.

The insulation element 68 is disposed on an outer surface of the resistance heating element 67 so that power to make the resistance heating element 67 generate heat is stably applied. The insulation element 68 is made of a light transmitting material of a glass-based material, so that the radiant heat permeating the support element 66 and the resistance heating element 67 and the resistance heat generated from the resistance heating element 67, can be easily transferred to the paper passing through the fusing nip.

Referring again to FIG. 2, the fusing belt 61 includes a substrate made of a polymer material such as polyimide (PI) or polyetheretherketone (PEEK), or a metal material such as nickel (Ni), Ni alloy, stainless steel, aluminum (Al), Al alloy, copper (Cu) or Cu alloy. The fusing belt 61 may further include a radiation absorption layer (not illustrated) formed on the substrate, for photothermal conversion with respect to the radiant heat transferred from the indirect heating member 62.

The pressing unit 70 is configured to rotate to drive the fusing belt 61. The pressing unit 70 includes a core pipe 71 which is made of metal (e.g., iron, stainless steel, aluminum or copper), metal alloy, ceramics or fiber-reinforced metal (FRM), an elastic layer 72 which is disposed on an outer surface of the core pipe 71, and a contact layer 73 which is disposed on an outer surface of the elastic layer 72. The elastic layer 72 is made of silicon rubber or fluoro rubber, and the contact layer 73 is made of fluoro rubber, silicon rubber or fluoro resin.

Figure 4:
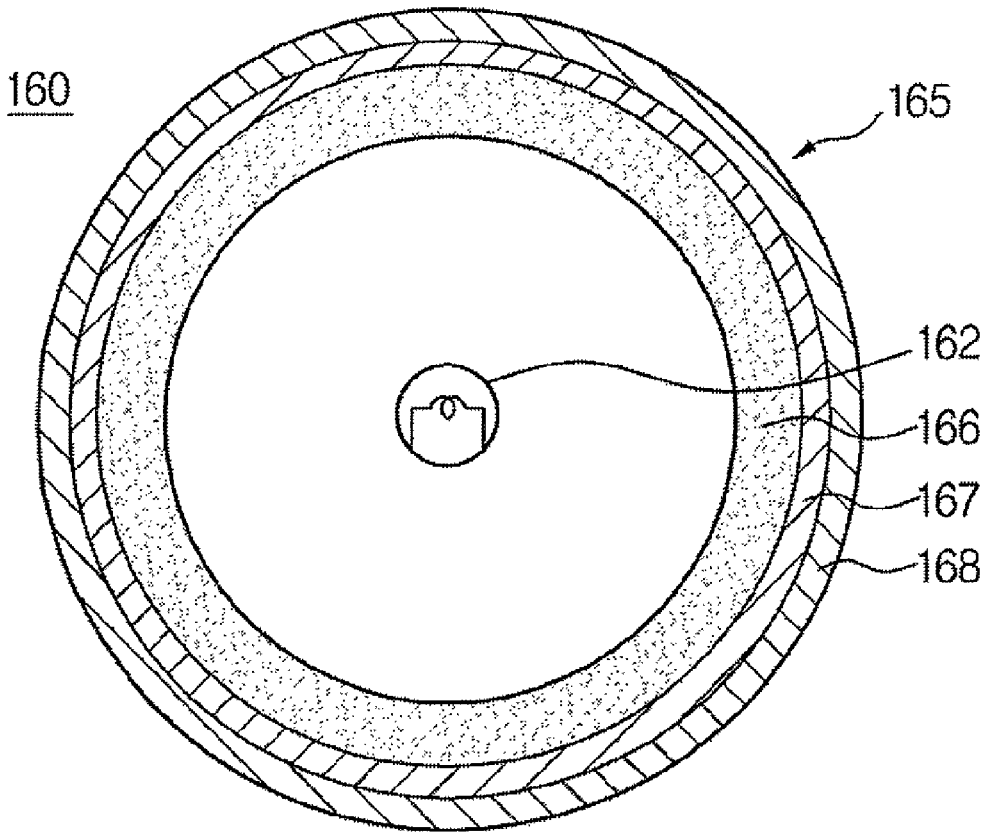
FIG. 4 is a sectional view illustrating another embodiment of the heating unit of the image forming apparatus in accordance with the present general inventive concept.

FIG. 4 is a sectional view illustrating another embodiment of the heating unit of the image forming apparatus in accordance with the present general inventive concept.

As illustrated in FIG. 4, a heating unit 160 of the fusing device 50 according to another embodiment includes a heat roller 165 to generate resistance heat when power is applied thereto, and an indirect heating member 162 disposed inside the heat roller 165.

If power is applied to the indirect heating member 162, the indirect heating member 162 generates radiant heat and transfers the heat to the visible image formed on the paper passing through the fusing nip formed between the heating unit 160 and the pressing unit 70. The indirect heating member 162, for example, may be configured as a halogen lamp.

The heat roller 165 includes a support pipe 166 as a support element, a resistance heating element 167 disposed on an outer surface of the support pipe 166 and generates resistance heat when power is applied thereto, and an insulation element 168 disposed on the outer surface of the resistance heating element 167 so that power is stably applied to the resistance heating element 167.

The support pipe 166 is made of a ceramic material such as silicon dioxide ($SiO_2$) or aluminum oxide ($Al_2O_3$), or a light transmitting material of a high heat-resistant polymer material such as polyimide (PI), so that the radiant heat from the indirect heating member 162 can permeate the support pipe 166.

The resistance heating element 167 is coated with a resistance heating material so as to generate resistance heat when power is applied thereto. The resistance heating element 167 is made of a ceramic material such as zinc oxide (ZnO), indium tin oxide (ITO) or tin dioxide ($SnO_2$), or a light transmitting material such as carbon nanotube (CNT) or polythiophene-based conductive polymer, so that the radiant heat permeating the support pipe 166 can permeate the resistance heating element 167.

The insulation element 168 is made of a light transmitting material of a glass-based material, so that the radiant heat permeating the support pipe 166 and the resistance heating element 167 and the resistance heat generated from the resistance heating element 167, can be easily transferred to the paper passing through the fusing nip.

Figure 5:
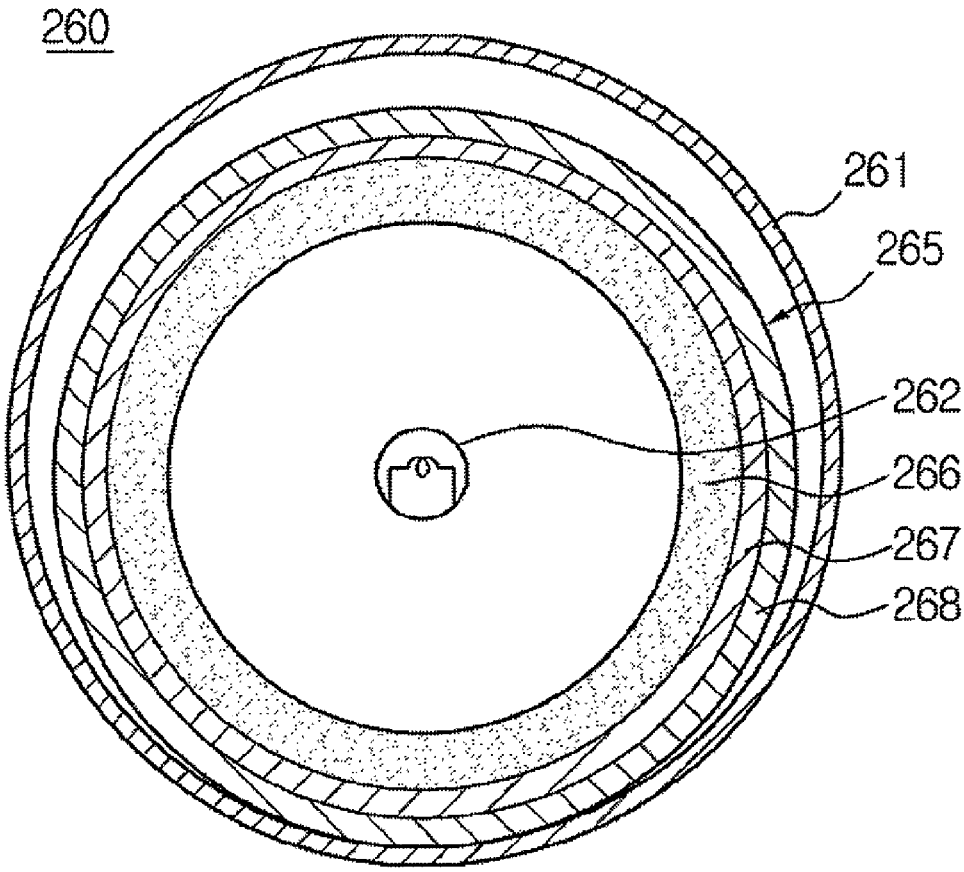
FIG. 5 is a sectional view illustrating yet another embodiment of the heating unit of the image forming apparatus in accordance with the present general inventive concept.

FIG. 5 is a sectional view illustrating yet another embodiment of the heating unit of the image forming apparatus in accordance with the present general inventive concept.

As illustrated in FIG. 5, a heating unit 260 of the fusing device 50 according to yet another embodiment includes a heat roller 265 to generate resistance heat, an indirect heating member 262 disposed inside the heat roller 265 to generate radiant heat, and a fusing belt 261 disposed around the heat roller 265 to form the fusing nip between the pressing unit 70 and the fusing belt 261.

The heat roller 265 includes a support pipe 266 as a support element, a resistance heating element 267 disposed on an outer surface of the support pipe 266 and generates resistance heat when power is applied thereto, and an insulation element 268 disposed on an outer surface of the resistance heating element 267 so that power is stably applied to the resistance heating element 267.

The support pipe 266 is made of a ceramic material such as silicon dioxide ($SiO_2$) or aluminum oxide ($Al_2O_3$), or a light transmitting material of a high heat-resistant polymer material such as polyimide (P1), so that the radiant heat from the indirect heating member 262 can permeate the support pipe 266.

The resistance heating element 267 is coated with a resistance heating material so as to generate resistance heat when power is applied thereto. The resistance heating element 267 is made of a ceramic material such as zinc oxide (ZnO), indium tin oxide (ITO) or tin dioxide ($SnO_2$), or a light transmitting material such as carbon nanotube (CNT) or polythiophene-based conductive polymer, so that the radiant heat permeating the support pipe 266 can permeate the resistance heating element 267.

The insulation element 268 is made of a light transmitting material of a glass-based material, so that the radiant heat permeating the support pipe 266 and the resistance heating element 267 and the resistance heat generated from the resistance heating element 267, can be easily transferred to the paper passing through the fusing nip.

Hereinafter, an operation and effect of the image forming apparatus according to an embodiment of the present general inventive concept will be described.

Referring to FIG. 1, the visible image is formed on the paper by the developing device 30 having the developer of four colors, and fused to the paper by heat and pressure while the paper passes through the fusing nip formed at the fusing device 50.

Referring to FIGS. 3 to 5, in the image fusing process, power is applied to the direct heating member 65, 165 or 265 and the indirect heating member 62, 162 or 262 of the heating unit 60, 160 or 260. When power is applied to the direct heating member 65, 165 or 265, the resistance heating element of the direct heating member 65, 165 or 265 generates resistance heat, and the resistance heat is directly transferred to the visible image formed on the paper passing through the fusing nip. When power is applied to the indirect heating member 62, 162 or 262, radiant heat is generated and indirectly transferred to the visible image formed on the paper passing through the fusing nip. Because the support element 66, 166 or 266, the resistance heating element 67, 167 or 267 and the insulation element 68, 168 or 268 of the direct heating member 65, 165 or 265 are made of a light transmitting material, the radiant heat can be easily transferred to the visible image on the paper.

Also, since radiant heat generated from the indirect heating member 62, 162 or 262 heats the direct heating member 65, 165 or 265, a heating rate of the direct heating member 65, 165 or 265 increases. Furthermore, since the direct heating member 65, 165 or 265 generates heat by being applied with power and directly transfers the heat to the visible image on the paper, the warm-up time required to reach a predetermined fusing temperature to fuse the visible image is shortened.

Also, since power is applied to the indirect heating member 62, 162 or 262 and the direct heating member 65, 165 or 265 at a same time to transfer heat to the visible image on the paper, the indirect heating member 62, 162 and 262 is prevented from flickering due to a low resistance in an early stage of heating.

The present general inventive concept can also be embodied as computer-readable codes on a computer-readable medium. The computer-readable medium can include a computer-readable recording medium and a computer-readable transmission medium. The computer-readable recording medium is any data storage device that can store data that can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet). Also, functional programs, codes, and code segments to accomplish the present general inventive concept can be easily construed by programmers skilled in the art to which the present general inventive concept pertains.

As apparent from the above description, the image forming apparatus according to various embodiments of the present general inventive concept is configured such that an indirect heating member generating radiant heat and a direct heating member generating resistance heat operate simultaneously to transfer the heat to a visible image formed on a printing medium, thereby shortening a warm-up time required to reach a predetermined fusing temperature in a heating unit.

Although various embodiments of the present general inventive concept have been illustrated and described, it would be appreciated by those skilled in the art that changes may be made in these embodiments without departing from the principles and spirit of the general inventive concept, the scope of which is defined in the claims and their equivalents.

What is claimed is:

1. An image forming apparatus including a heating unit and a pressing unit which forms a fusing nip between the heating unit and the pressing unit to fuse a visible image formed on a printing medium, the image forming apparatus comprising:

the heating unit including an indirect heating member disposed inside a fusing belt of the heating unit to generate a radiant heat and to indirectly transfer the radiant heat to the visible image formed on the printing medium passing through the fusing nip and a direct heating member having a resistance heating element to generate a resistance heat and to directly transfer the resistance heat to the visible image formed on the printing medium passing through the fusing nip, wherein the direct heating member includes the resistance heating element to generate the resistance heat when power is applied to the resistance heating element, and an insulation element disposed on the resistance heating element so that power is stably applied to the resistance heating element, and wherein the heating unit includes a support element to support the resistance heating element and the insulation element, and the support element includes a ceramic material selected from the group consisting of $SiO_2$ and $Al_2O_3$, or a light transmitting material of a high heat-resistant polymer material, wherein the high heat-resistant polymer material is PI.

2. The image forming apparatus according to claim 1, wherein the resistance heating element includes a ceramic material selected from the group consisting of ZnO, ITO, and $SnO_2$, or a light transmitting material selected from the group consisting of carbon nanotube (CNT) and polythiophene-based conductive polymer, so that the radiant heat generated from the indirect heating member can permeate the resistance heating element.

3. The image forming apparatus according to claim 1, wherein the insulation element includes a light transmitting glass material so that the radiant heat permeating the resistance heating element permeates the insulation element.

4. An image forming apparatus including a fusing device having a heating unit and a pressing unit which is mounted opposite to the heating unit to fuse a visible image formed on a printing medium, the image forming apparatus comprising:

the heating unit including a fusing belt, an indirect heating member disposed inside the fusing belt to generate radiant heat, and a direct heating member which the radiant heat generated from the indirect heating member permeates and which generates resistance heat with a resistance heating element, wherein the direct heating member includes:

a support element including a ceramic material selected from the group consisting of $SiO_2$ and $Al_2O_3$, or a light transmitting material of a high heat-resistant polymer material, wherein the high heat-resistant polymer material is PI;

the resistance heating element is disposed on the support element to generate resistance heat when power is applied to the resistance heating element; and an insulation element is disposed on the resistance heating element so that power is stably applied to the resistance heating element.

5. The image forming apparatus according to claim 4, wherein the resistance heating element includes a ceramic material selected from the group consisting of ZnO, ITO, and $SnO_2$, or a light transmitting material selected from the group consisting of carbon nanotube (CNT) and polythiophene-based conductive polymer, so that the radiant heat generated from the indirect heating member can permeate the resistance heating element.

6. The image forming apparatus according to claim 4, wherein the insulation element includes a light transmitting glass material so that the radiant heat permeating the resistance heating element permeates the insulation element.

7. An image forming apparatus including a fusing device having a heating unit and a pressing unit which is mounted opposite to the heating unit to fuse a visible image formed on a printing medium, the image forming apparatus comprising:

the heating unit including a fusing belt, an indirect heating member disposed inside the fusing belt to generate radiant heat, and a direct heating member which the radiant heat generated from the indirect heating member permeates and which generates resistance heat with a resistance heating element, wherein the direct heating member includes:

a support element;

the resistance heating element is disposed on the support element to generate resistance heat when power is applied to the resistance heating element; and an insulation element is disposed on the resistance heating element so that power is stably applied to the resistance heating element, and wherein the support element comprises:

shafts to protrude outward from both sides of the support element;

bushings to press the shafts; and elastic members to elastically support the bushings disposed at the respective shafts to form a fusing nip between the fusing belt and the pressing unit.

8. An image forming apparatus including a fusing device having a heating unit and a pressing unit which is mounted opposite to the heating unit to fuse a visible image formed on a printing medium, the image forming apparatus comprising:

the heating unit including a heat roller having a resistance heating element to generate resistance heat;

an indirect heating member disposed inside the heat roller to generate radiant heat;

and a fusing belt disposed around the heat roller to form a fusing nip between the pressing unit and the fusing belt, wherein the heat roller includes:

a support pipe;

the resistance heating element disposed on an outer surface of the support pipe;

and an insulation element disposed on an outer surface of the resistance heating element.

9. The image forming apparatus according to claim 8, wherein the support pipe includes a ceramic material selected from the group consisting of $SiO_2$ and $Al_2O_3$, or a light transmitting material of a high heat-resistant polymer material, wherein the high heat-resistant polymer material is PI.

10. The image forming apparatus according to claim 8, wherein the resistance heating element includes a ceramic material selected from the group consisting of ZnO, ITO, and $SnO_2$, or a light transmitting material selected from the group consisting of carbon nanotube (CNT) and polythiophene-based conductive polymer, so that the radiant heat generated from the indirect heating member can permeate the resistance heating element.

11. The image forming apparatus according to claim 8, wherein the insulation element includes a light transmitting glass material so that the radiant heat permeating the resistance heating element permeates the insulation element,

12. A method to fuse a visible image on a printing medium, the method comprising:

passing the printing medium through a fusing nip;

generating resistance heat with a first heating element to directly transfer to the printing medium passing through the fusing nip;

supporting the first heating element a ceramic material selected from the group consisting of $SiO_2$ and $Al_2O_3$, or a light transmitting material of a high heat-resistant polymer material, wherein the high heat-resistant polymer material is PI; and generating radiant heat with a second heating element to indirectly transfer to the printing medium passing through the fusing nip.

13. The method of claim 12, wherein the resistance heat and the radiant heat are simultaneously generated.

* * * * *